US008454406B1

(12) United States Patent
Yang

(10) Patent No.: US 8,454,406 B1
(45) Date of Patent: Jun. 4, 2013

(54) CHORUSING TOY SYSTEM

(75) Inventor: Ming-Tse Yang, Taipei (TW)

(73) Assignee: Sap Link Technology Corp., Taipei (TW)

( * ) Notice: Subject to any disclaimer, the term of this patent is extended or adjusted under 35 U.S.C. 154(b) by 0 days.

(21) Appl. No.: 13/479,972

(22) Filed: May 24, 2012

(51) Int. Cl.
*A63H 5/00* (2006.01)

(52) U.S. Cl.
USPC ..... 446/397; 446/491; 84/600; 84/609

(58) Field of Classification Search
USPC ..... 446/397, 491; 84/600, 609
See application file for complete search history.

(56) References Cited

U.S. PATENT DOCUMENTS 5,438,154 A * 8/1995 Segan et al. ..... 84/600
5,587,545 A * 12/1996 Nakada et al. ..... 84/600
6,822,154 B1 * 11/2004 Thai ..... 84/609
2002/0155783 A1 * 10/2002 Chan ..... 446/335
2002/0187722 A1 * 12/2002 Fong et al. ..... 446/175
2004/0038620 A1 * 2/2004 Small et al. ..... 446/491
2008/0167739 A1 7/2008 Lin et al.
2011/0059677 A1 * 3/2011 Dang et al. ..... 446/397

* cited by examiner

*Primary Examiner* — Tramar Harper
(74) *Attorney, Agent, or Firm* — Muncy, Geissler, Olds & Lowe, PLLC

(57) ABSTRACT

A chorusing toy system includes multiple sound-generating devices. The sound-generating devices each include a storage module, a sound-generating unit, and a circuit module. The storage module stores a role-related datum, an ID datum, and at least a play datum. The circuit module is connected to the storage module and the sound-generating unit, and includes a starting switch and a playing switch. Once the starting switches are turned on, the circuit modules will execute a connection procedure whereby one of the sound-generating devices is defined as a master. Once the playing switches are turned on, the circuit modules will execute a playing procedure whereby the play datum are played by means of a playing unit of the sound-generating devices.

14 Claims, 9 Drawing Sheets

CHORUSING TOY SYSTEM

BACKGROUND OF THE INVENTION

1. Field of the Invention

The present invention relates to chorusing toys, and more particularly, to a chorusing toy system composed of multiple sound-generating devices.

2. Description of Related Art

Due to technological advancement, manufacturers nowadays have developed various robots and dolls each capable of playing a specific musical instrument independently. However, when it comes to playing chord music or symphonic music, the conventional robots and dolls are of no avail. In view of this, US20080167739 patent application discloses an autonomous robot and method for playing music and recognizing music notes. A number of the autonomous robots for playing music and recognizing music notes of the patent application can be grouped and perform together like a band or a chorus, so as to achieve the goal of playing a specific piece of music.

SUMMARY OF THE INVENTION

It is an objective of the present invention to provide a chorusing toy system capable of simulating a live performance and chorusing by means of multiple sound-generating devices.

In order to achieve the above and other objectives, the present invention provides a chorusing toy system. The chorusing toy system comprises multiple sound-generating devices. The sound-generating devices each comprise a storage module, a sound-generating unit, and a circuit module. The storage module stores a role-related datum, an ID datum, and at least a play datum. Each play datum corresponds to the role-related datum and has a name and multiple syllables. The circuit module is connected to the storage module and the sound-generating unit, and comprises a wireless unit, a starting switch, and a playing switch. Once the starting switches are turned on, the circuit modules will execute a connection procedure for connecting the circuit modules to each other via the wireless units and defining one of the sound-generating devices as a master in accordance with the priority of the role-related datum over each other. The circuit modules of the master create a member datum from the connected sound-generating devices and store the member datum in a storage module of the master. The member datum comprises the role-related datum and the ID datum of each sound-generating device. Once the playing switches of the circuit modules of the master are turned on, the circuit modules will execute a playing procedure. The playing procedure comprises the following steps.

With its wireless unit, the circuit module of the master sends the name of the playing datum to each sound-generating device included in the member datum, so as to turn on the playing switch of each sound-generating device.

With its wireless unit, the circuit module of each sound-generating device receives the name and sends a received signal to the wireless unit of the circuit module of the master.

After receiving the received signals, the circuit module of the master determines whether all the sound-generating devices have received the name in accordance with the received signals and the member datum. If the determination is affirmative, the wireless unit of the circuit module of the master will send a start signal. After the circuit module of the sound-generating devices has received the start signal, the sound-generating unit of the sound-generating devices starts playing each syllable of the play datum of the name. At the point in time when the playing of each syllable ends, the wireless unit of the circuit module of the sound-generating devices reports to the circuit module of the master, such that the circuit module of the master can monitor a play status. If the determination is negative, the circuit module of the master waits a predetermined time period before the circuit module of the master sends a start signal. After the circuit module of the sound-generating devices has received the start signal, the sound-generating unit of the sound-generating devices starts playing each syllable of the play datum of the name. At the point in time when the playing of each syllable ends, the wireless unit of the circuit module of the sound-generating devices reports to the circuit module of the master, such that the circuit module of the master can monitor a play status.

BRIEF DESCRIPTION OF THE SEVERAL VIEWS OF THE DRAWINGS

Objectives, features, and advantages of the present invention are hereunder illustrated with specific embodiments in conjunction with the accompanying drawings, in which.

DETAILED DESCRIPTION OF THE EMBODIMENTS OF THE INVENTION

In an embodiment of the present invention, a chorusing toy system comprising multiple sound-generating devices is provided. In this embodiment, the chorusing toy system is exemplified by an orchestra, and the sound-generating devices simulate members of the orchestra.

Figure 1:
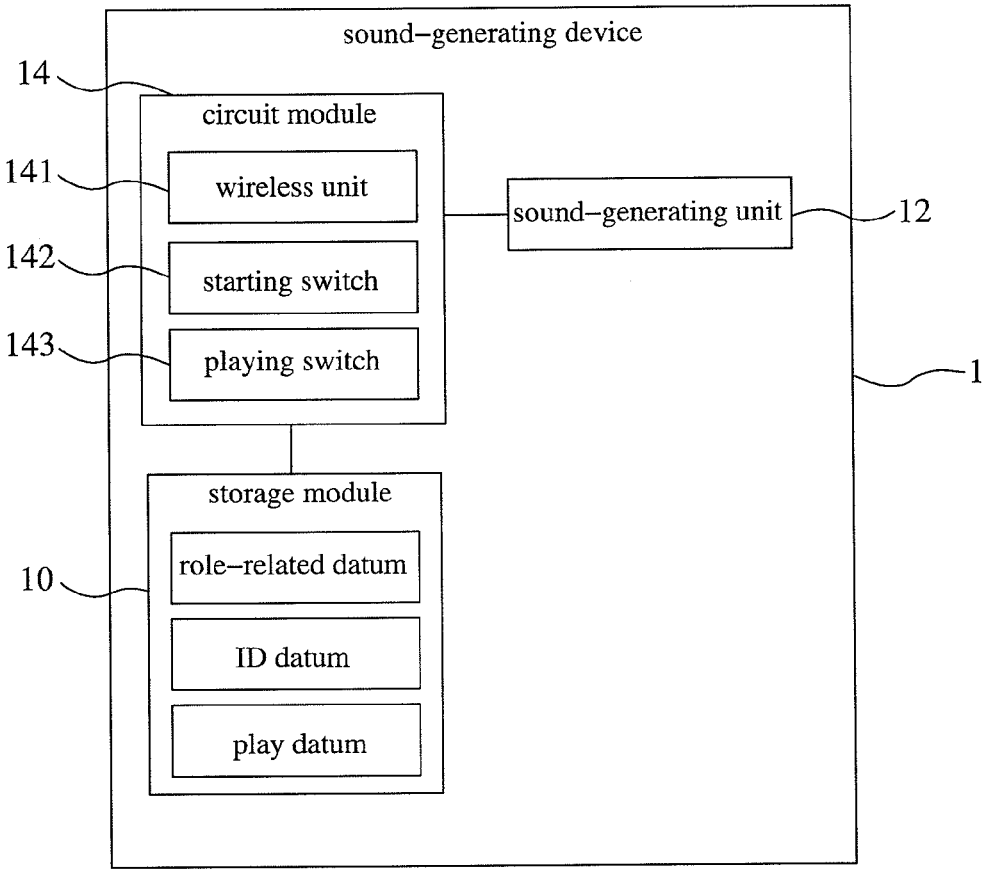
FIG. 1 is a block diagram of a sound-generating device according to a preferred embodiment of the present invention.

Referring to FIG. 1, there is shown a block diagram of a sound-generating device according to a preferred embodiment of the present invention. As shown in FIG. 1, a sound-generating device 1 comprises a storage module 10, a sound-generating unit 12, and a circuit module 14. The storage module 10 stores a role-related datum, an ID datum, and at least a play datum. Each play datum corresponds to the role-related datum and has a name and multiple syllables. The storage module 10 is a flash memory or a solid-state hard disk drive. The circuit module 14 is connected to the storage module 10 and the sound-generating unit 12, and comprises a wireless unit 141, a starting switch 142, and a playing switch 143.

Figure 2:
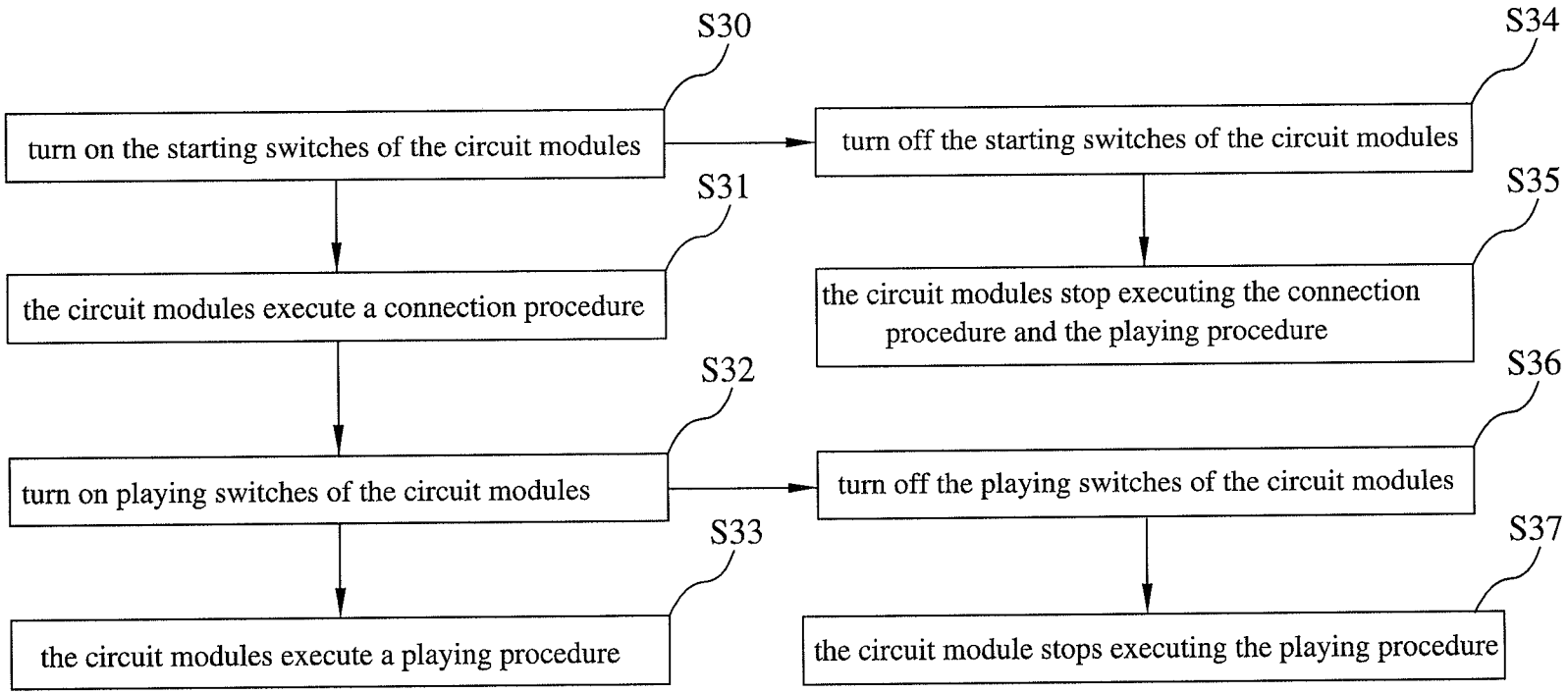
FIG. 2 is a flowchart of the operation of a chorusing toy system according to a preferred embodiment of the present invention.

Referring to FIG. 2, there is shown a flowchart of the operation of a chorusing toy system according to a preferred embodiment of the present invention. As shown in FIG. 2, the operation of the chorusing toy system involves the following steps. S30: turn on starting switches of the circuit modules of the sound-generating devices. S31: the circuit modules execute a connection procedure such that the circuit modules are connected to each other via the wireless units, and one of the sound-generating devices is defined as a master in accordance with the priority of the role-related datum over each other. S32: turn on playing switches of the circuit modules of the sound-generating devices. S33: the circuit modules execute a playing procedure. S34: turn off the starting switches of the circuit modules. S35: the circuit modules stop executing the connection procedure and the playing procedure. S36: turn off the playing switches of the circuit modules. S37: the circuit module stops executing the playing procedure. A point to note is that the connection procedure cannot be terminated while the execution of the playing procedure is underway. In the situation where only the starting switch of one of the sound-generating devices is turned off, the sound-generating device thus shut down stops executing the connection procedure and the playing procedure, whereas the other sound-generating devices which are not shut down continue executing the connection procedure and the playing procedure. When only the playing switch of one of the sound-generating devices is turned off, the sound-generating device stops executing the playing procedure, whereas the other sound-generating devices continue executing the playing procedure and the connection procedure.

Figure 3:
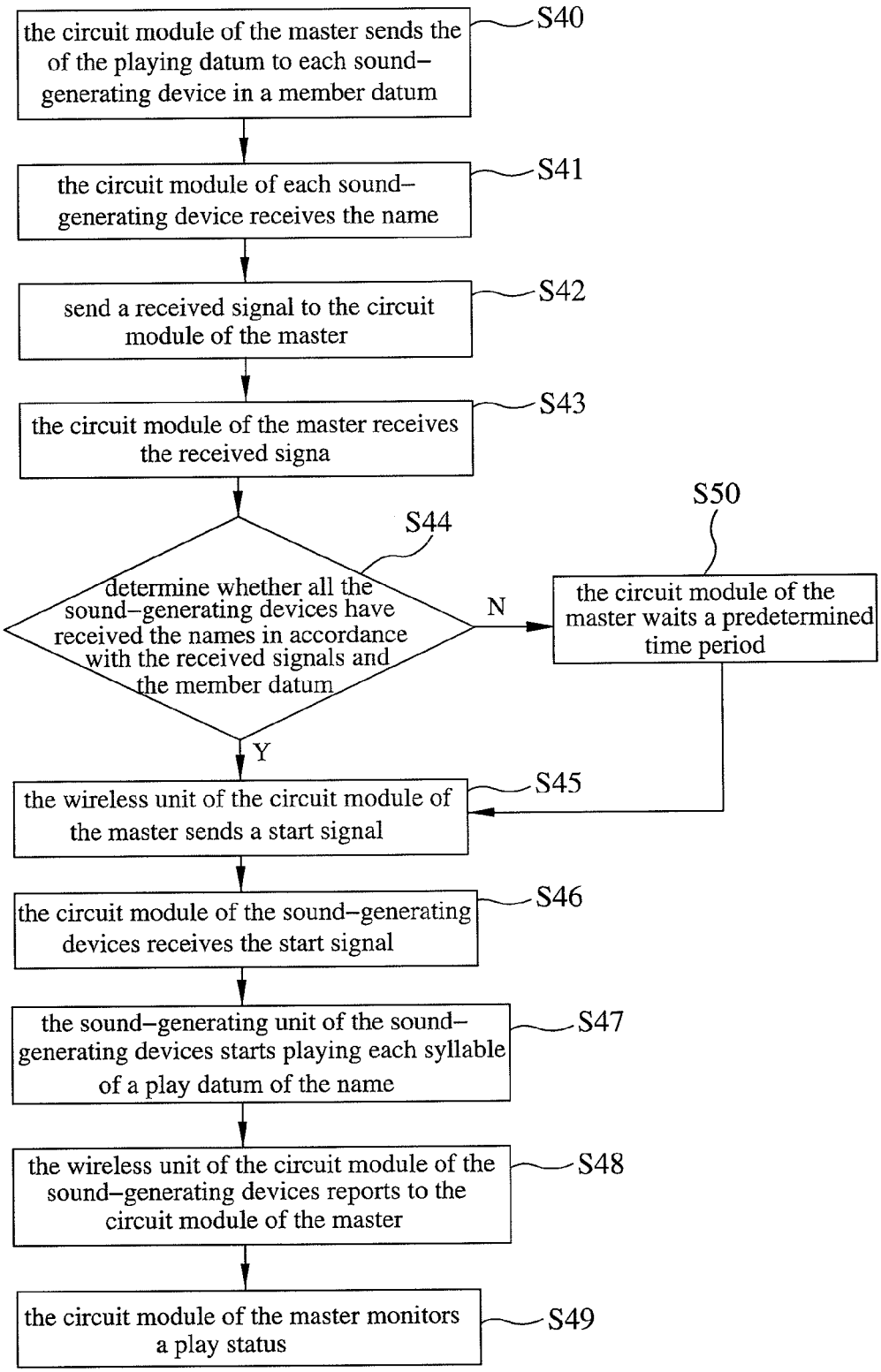
FIG. 3 is a flowchart of a playing procedure in FIG. 2.

Referring to FIG. 3, there is shown a flowchart of the playing procedure in FIG. 2. The playing procedure comprises the following steps:

S40: with its wireless unit, the circuit module of the master sends the name of the playing datum to each sound-generating device included in a member datum, so as to turn on the playing switch of each sound-generating device;

S41: with its wireless unit, the circuit module of each sound-generating device receives the name;

S42: the circuit module of each sound-generating device sends a received signal to the wireless unit of the circuit module of the master.

S43: the circuit module of the master receives the received signal.

S44: determine whether all the sound-generating devices have received the names in accordance with the received signals and the member datum. Go to step S45, when the determination is affirmative. Go to step S50, when the determination is negative.

S45: the wireless unit of the circuit module of the master sends a start signal.

S46: the circuit module of the sound-generating devices receives the start signal.

S47: the sound-generating unit of the sound-generating devices starts playing each syllable of a play datum of the name. Go to step S48 as soon as the playing of each syllable ends.

S48: the wireless unit of the circuit module of the sound-generating devices reports to the circuit module of the master.

S49: the circuit module of the master monitors a play status.

S50: the circuit module of the master waits a predetermined time period. Step S50 is followed by step S45.

S45: the wireless unit of the circuit module of the master sends a start signal.

S46: the circuit module of the sound-generating devices receives the start signal.

S47: the sound-generating unit of the sound-generating devices starts playing each syllable of a play datum of the name. Go to step S48 as soon as the playing of each syllable ends.

S48: the wireless unit of the circuit module of the sound-generating devices reports to the circuit module of the master.

S49: the circuit module of the master monitors a play status.

The start signal in the former step S45 is the same as the start signal in the latter step S45. Preferably, the predetermined time period lasts two seconds. This embodiment is exemplified by a datum transmission cycle. From the perspective of the datum transmitted by wireless transmission technology of the present invention, a datum transmission cycle is shorter than 0.5 second, though it can be extended to five seconds. Hence, the present invention is not limited to a predetermined time period of two seconds.

Musical instruments for use with an orchestra usually comprise two violins, a viola, a violoncello, a contrabass, a piano, an oboe, a clarinet, a flute, a piano, a bassoon, a trumpet, a French horn, a harp, a percussion instrument, a kettledrum, a trombone, and a bass horn. The role-related datum correspond to the aforesaid musical instruments in a one-to-one manner. Musical scores are stored in the sound-generating devices in accordance with the roles thereof, respectively. For example, the violinists are stored with violin-related musical scores, using play datum of the same name. The stored musical scores not only vary from sound-generating device to sound-generating device, but also vary according to the musical instruments that match the roles of the sound-generating devices, respectively. In this embodiment, datum related to the roles of the sound-generating devices fall into the following categories according to their respective musical instruments: the datum related to the role of the sound-generating device of the violin are preset to 01, 02; the datum related to the role of the sound-generating device of the viola is preset to 03, the datum related to the role of the sound-generating device of the violoncello is preset to 04; the datum related to the role of the sound-generating device of the contrabass is preset to 05; the datum related to the role of the sound-generating device of the oboe is preset to 06; the datum related to the role of the sound-generating device of the clarinet is preset to 07; the datum related to the role of the sound-generating device of the flute is preset to 08; and the datum related to the role of the sound-generating device of the piano is preset to 09. The aforesaid musical instruments can be sorted by analogy. Furthermore, the sound-generating unit of each sound-generating device can generate sound typical of the corresponding musical instrument. For instance, the sound-generating units of the sound-generating devices which play the violins can generate the tone typical of the violins.

During a symphonic performance, the conductor usually plays the paramount commander's role. However, if the orchestra lacks a conductor, the first violinist (denoted by the aforesaid role-related datum 01) will play the paramount commander's role. According to the sequence of the aforesaid role-related datum, the sound-generating device denoted with the role-related datum 01 is a master. The master stores member-related datum and controls the playing status of each sound-generating device. In doing so, under the first violinist's control, the sound-generating devices play the play datum of the same name by following the aforesaid playing procedure, so as to simulate a symphonic performance.

In practice, the role-related datum of the sound-generating devices may repeat. For example, the sound-generating device of the violoncello is denoted with two pieces of role-identifying datum of 04, whereas the sound-generating device of the flute is denoted with four pieces of role-identifying datum of 08. By contrast, the ID-identifying datum of the sound-generating devices do not repeat. There are variations in the appearance, style, and operation of the aforesaid sound-generating devices which take different roles, depending on their roles (corresponding to the musical instruments.) For example, to start playing, the sound-generating device playing the role of the violin has a violin and is capable of playing the violin, whereas the sound-generating device playing the role of the piano has a piano and is capable of playing the piano.

Alternatively, the sound-generating devices come in another style and generate another sound. For example, the sound-generating device playing the role of a Chinese comic dialogue performer performs a Chinese comic dialogue. The sound-generating device playing the role of a singer sings. The sound-generating device playing the role of an anchor anchors a newscast. The sound-generating device playing the role of an English teacher reads out in English. However, the aforesaid sound-generating devices playing the roles of a Chinese comic dialogue performer, a singer, an anchor, and an English teacher, respectively, have to work in conjunction with the play datum pertaining to their respective sounds. Hence, the chorusing toy system of the present invention can also simulate a Chinese comic dialogue performance, a concert performance, a newscast, language learning, etc. However, when only one sound-generating device is available, the sound-generating device can play the play datum on its own. Preferably, multiple sound-generating devices are provided.

Figure 4:
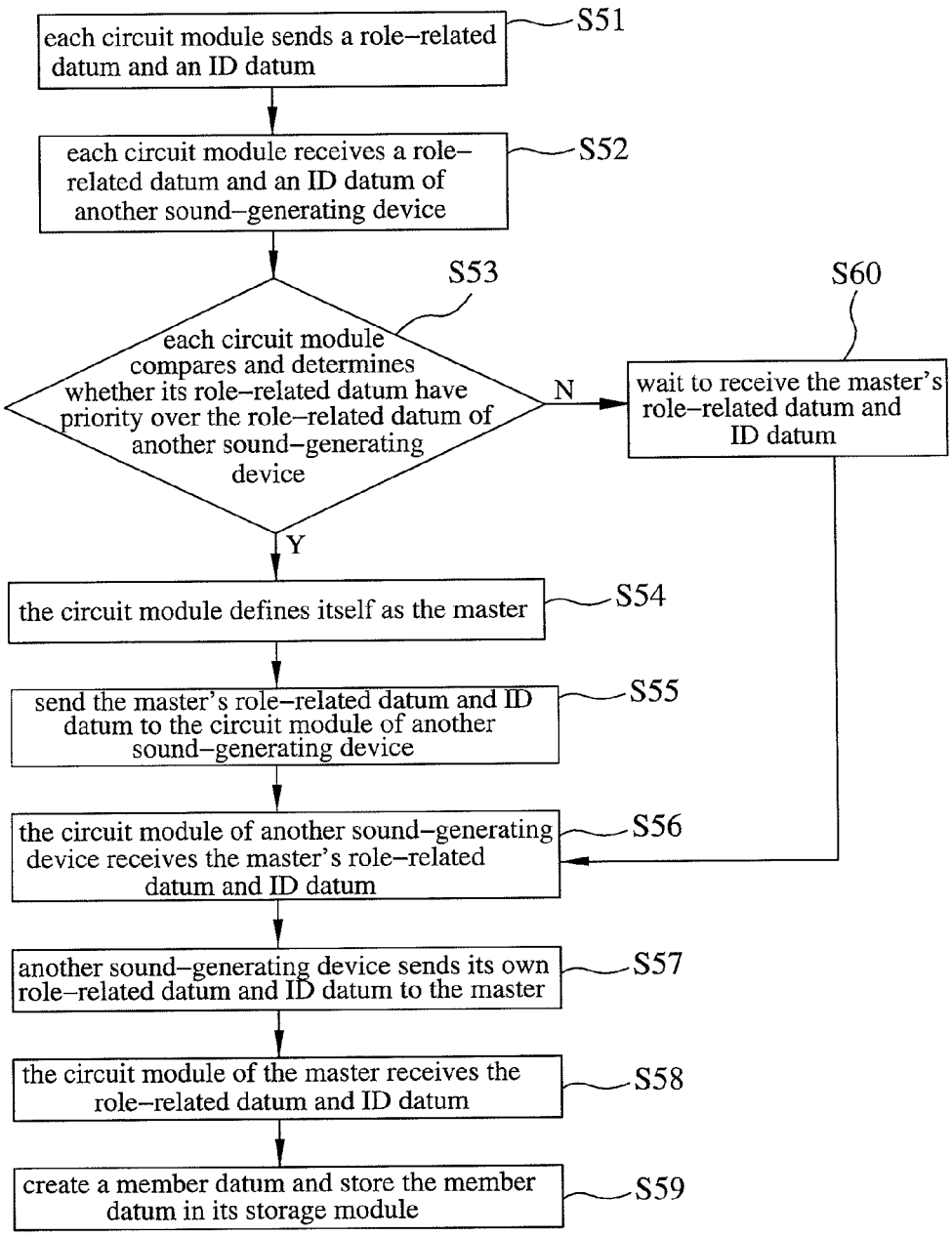
FIG. 4 is a flowchart of a connection procedure in FIG. 2.

Referring to FIG. 4, there is shown a flowchart of the connection procedure in FIG. 2. Initially, the sound-generating devices have no idea as to who the master is. Hence, the connection procedure comprises the following steps.

S51: the wireless unit of each circuit module sends a role-related datum and an ID datum;

S52: the wireless unit of each circuit module receives a role-related datum and an ID datum of another sound-generating device; and S53: each circuit module compares and determines whether its role-related datum have priority over the role-related datum of another sound-generating device; if the determination is affirmative, go to step S54; if the determination is negative, go to step S60.

S54: the circuit module defines itself as the master.

S55: the wireless unit of the circuit module sends the master's role-related datum and ID datum to the circuit module of another sound-generating device.

S56: the circuit module of another sound-generating device receives the master's role-related datum and ID datum.

S57: the circuit module of another sound-generating device sends its own role-related datum and ID datum to the master.

S58: the circuit module of the master receives the role-related datum and ID datum.

S59: create a member datum and store the member datum in its storage module.

S60: wait to receive the master's role-related datum and ID datum.

Upon completion of step S51 and step S52, the sound-generating devices confirm that they can undergo wireless communication with each other. In step S53, the circuit module of each sound-generating device compares and determines whether its own role-related datum has priority over the role-related datum of another sound-generating device. If the sound-generating device determines that it has priority over all the other connected sound-generating devices (for example, when it determines that it has the role-related datum 01 of the sound-generating device of the aforesaid first violinist,) the sound-generating device of the first violinist will define itself as the master, and the subsequent steps S55~S59 will be executed. At the end of the execution of step S58, the circuit module of the master knows how many members there are (in accordance with the ID datum) and know how many roles are played by the members (in accordance with the role-related datum.) If the sound-generating device determines that it does not have priority over all the other connected sound-generating devices (for example, when it determines that the sound-generating device of the aforesaid oboe is denoted by the role-related datum 06,) the sound-generating device waits to receive the master's role-related datum and ID datum, and then go to step S56.

Figure 5:
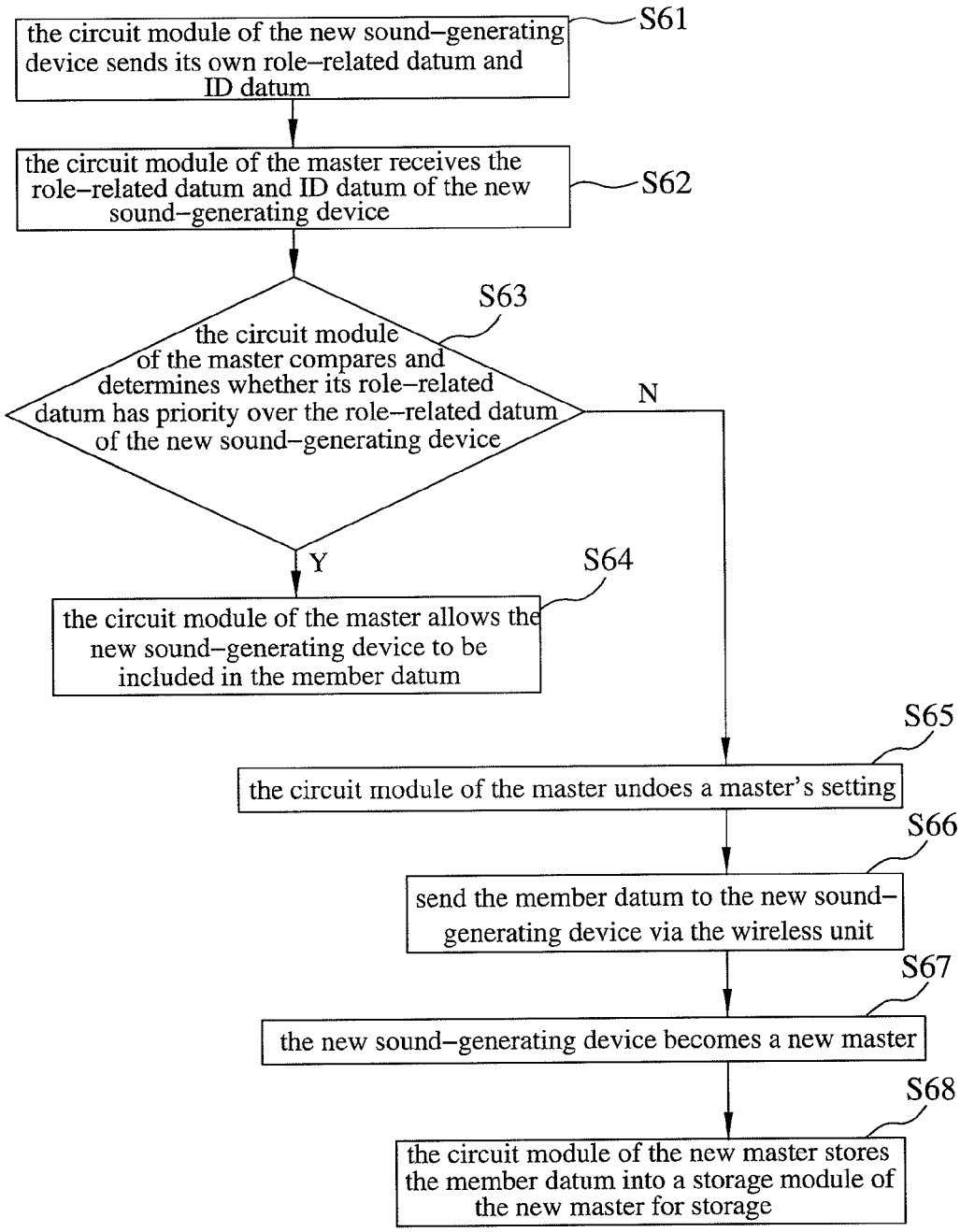
FIG. 5 is a flowchart of a participating procedure.

In particular, when the sound-generating devices have finished the connection procedure, it means that a master has created a member datum; meanwhile, if the starting switch of a new sound-generating device is turned on, the new sound-generating device will be a sound-generating device not included in the member datum, such that the circuit module of the new sound-generating device and the master execute a participating procedure. Referring to FIG. 5, there is shown a flowchart of the participating procedure. The participating procedure comprises the following steps.

S61: the wireless unit of the circuit module of the new sound-generating device sends its own role-related datum and ID datum.

S62: the circuit module of the master receives the role-related datum and ID datum of the new sound-generating device.

S63: the circuit module of the master compares and determines whether its role-related datum has priority over the role-related datum of the new sound-generating device. Go to step S64, when the determination is affirmative. Go to step S65, when the determination is negative.

S64: the circuit module of the master allows the new sound-generating device to be included in the member datum.

S65: the circuit module of the master undoes a master's setting.

S66: the wireless unit of the circuit module of the master sends the member datum to the new sound-generating device.

S67: the new sound-generating device becomes a new master.

S68: the circuit module of the new master sends the member datum to a storage module of the new master for storage.

Upon completion of step S61 and step S62, the master knows that new members are available. Step S62 is followed by step S63.

S63: determine the priority given to the role-related datum. For example, if the role-related datum of the new sound-generating device is 07 (clarinet), the sound-generating device (01) of the first violinist will have priority over the new sound-generating device, and thus the sound-generating device of the new clarinet will be included in the member datum, thereby indicating that the role-related datum and the ID datum of the new sound-generating device are also stored in the storage module of the master (first violinist). If the point in time when the new sound-generating device participates in the performance is specified in the playing procedure, the master will send to the new sound-generating device the name of the play datum being played and the syllables being played, such that the new sound-generating device can participate in the performance.

If the role-related datum of the new sound-generating device has priority over the role-related datum of the sound-generating device of the master, the sound-generating device of the master will surrender its leadership and send the connected member datum (including the master) to the new sound-generating device so as to carry out leadership handover, wherein the sound-generating device of the old master becomes a member. Devices which have priority over the first violinist are described later.

A point to note is that: if the role-related datum of the master equals the role-related datum of the new sound-generating device in priority, the circuit module of the master will have the new sound-generating device included in the member datum. For example, if the role-related datum of the new sound-generating device is 01 (first violinist), the master need not surrender its leadership, but the new sound-generating device will be included in the member datum. Once the playing procedure starts, the new sound-generating device will generate the same sound as the first violinist does, but a play status of the members will not be monitored.

Figure 6:
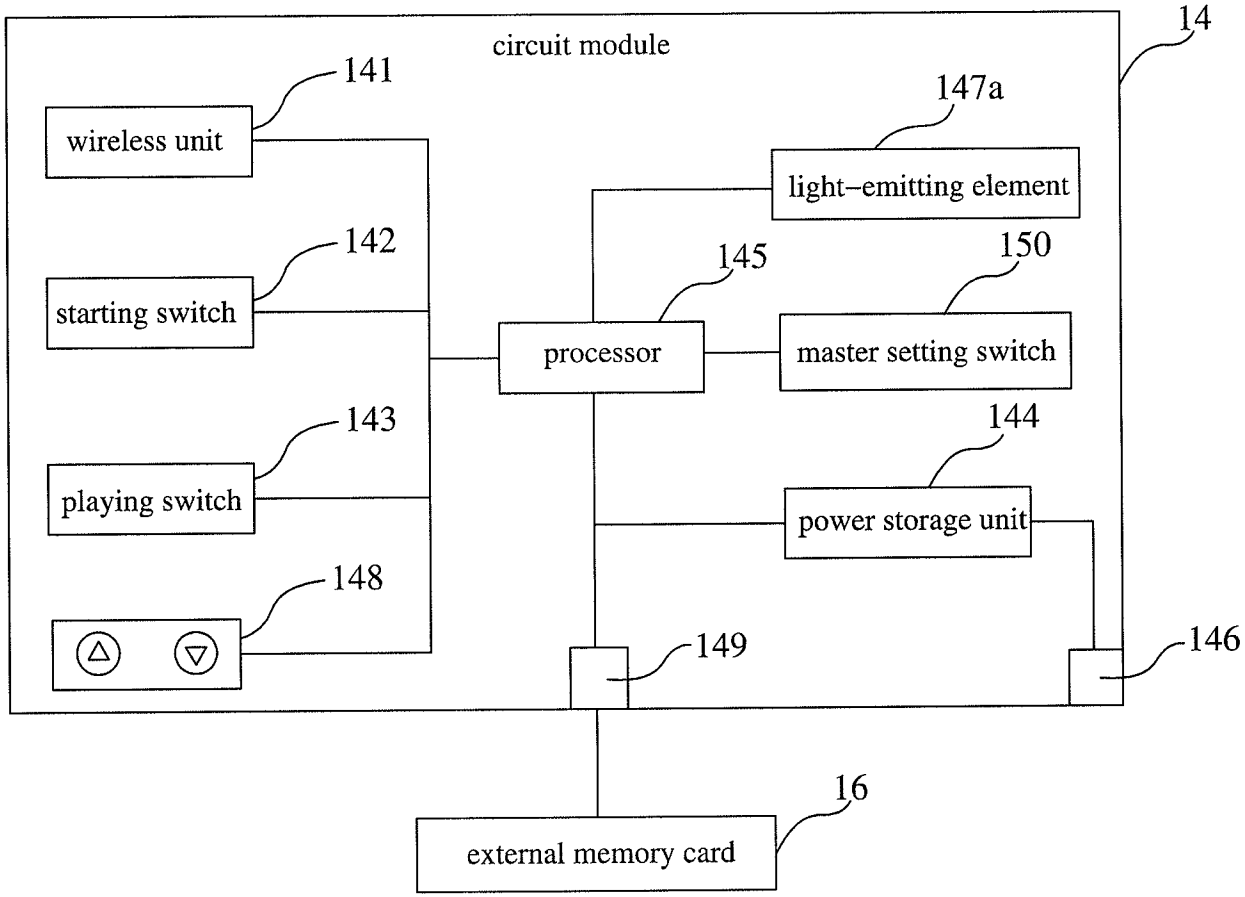
FIG. 6 is a block diagram of a circuit module of the sound-generating device in FIG. 1.

Referring to FIG. 6, each circuit module 14 further comprises a power storage unit 144 and a processor 145. The power storage unit 144 stores electrical energy and supplies electric power to the processor 145. The power storage unit 143 is a rechargeable battery, such as a lithium battery, a lithium iron phosphate battery, or a lithium iron lead-acid battery. The processor 145 is connected to the wireless unit 141, the starting switch 142, the playing switch 143, and the power storage unit 144.

Figure 7:
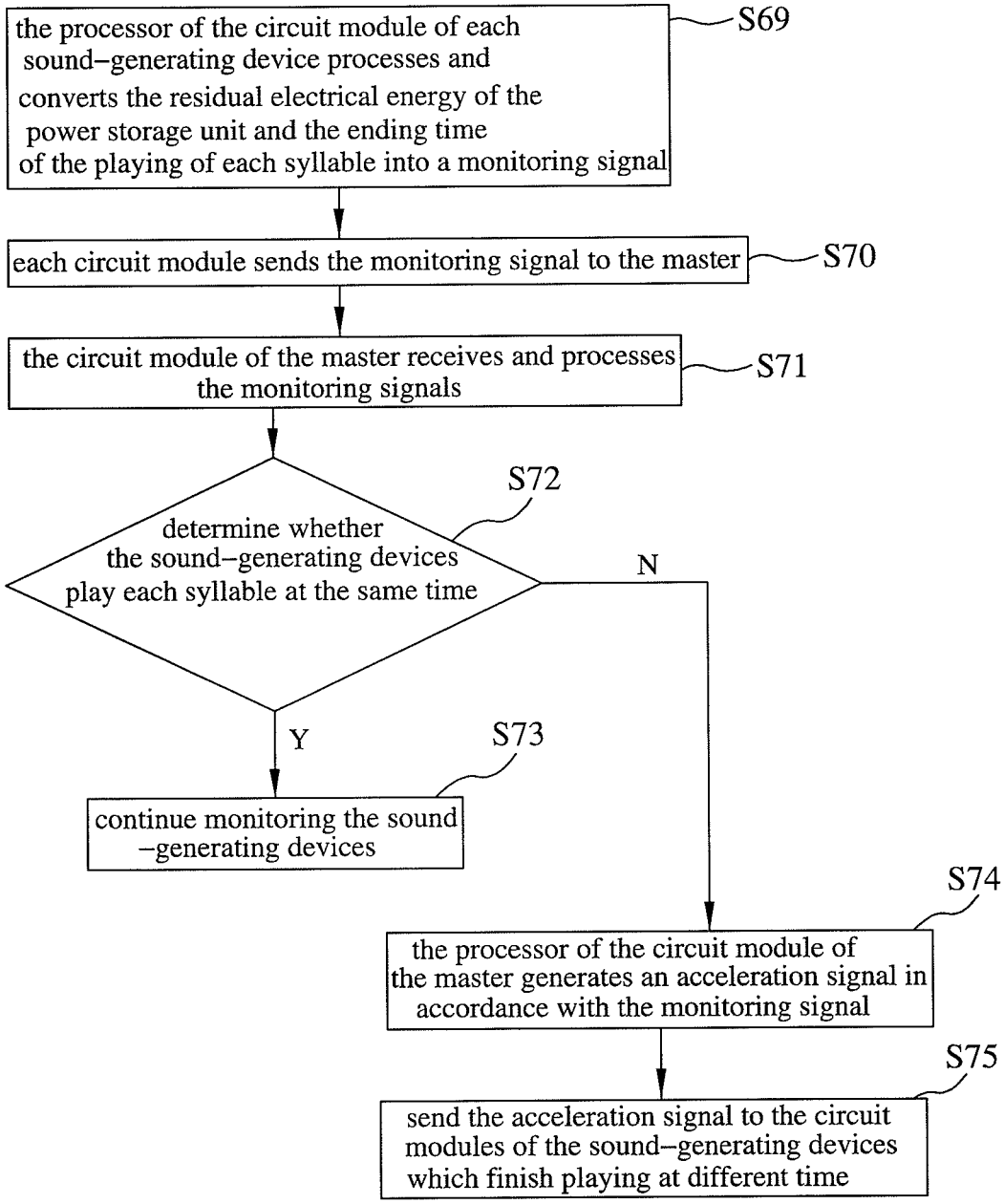
FIG. 7 is a flowchart of the playing procedure whereby the circuit module of a master monitors a play status.

Referring to FIG. 7, there is shown a flowchart of the playing procedure whereby the circuit module of the master monitors a play status. The playing procedure whereby the circuit module of the master monitors a play status comprises the following steps.

S69: the processor of the circuit module of each sound-generating device processes and converts the residual electrical energy of the power storage unit and the ending time of the playing of each syllable into a monitoring signal.

S70: each circuit module sends the monitoring signal to the master by means of the wireless unit.

S71: the circuit module of the master receives and processes the monitoring signals.

S72: determine whether the sound-generating devices play each syllable at the same time. Go to step S73, when the determination is affirmative. Go to step S74, when the determination is negative, for example, in a situation where the sound-generating device plays the same syllable later than another sound-generating device does.

S73: continue monitoring the sound-generating devices.

S74: the processor of the circuit module of the master generates an acceleration signal in accordance with the monitoring signal.

S75: send the acceleration signal to the circuit modules of the sound-generating devices which finish playing at different time, such that the sound-generating devices become equal in the playing speed thereof.

With energy-saving design being a feature of the processors of plenty circuit modules, the processors reduce electric power output in response to an undesirably low power level; as a result, the output of the sound-generating units of the sound-generating devices of the present invention slows down, thus indicating that a playing session has to be extended in order to reduce electric power consumption. However, reduction in speed slows down the sound generation of the sound-generating unit of the sound-generating device, and in consequence the performance is flawed with inharmonious noise. In view of this, the present invention proposes that, in case of an undesirably low power level, syllable playing should be speeded up at a rate proportional to the residual power level in the power storage unit, such that a sound-generating device with an undesirably low power level can catch up with another sound-generating device in terms of playing speed and rhythm.

Referring to FIG. 6, each circuit module 14 further comprises a charging connector 146 for connection with an external power source so as to charge the power storage unit 144 or supply electric power to the circuit module 14. The charging connector 146 is a conventional power connector, a USB connector, or any appropriate connector, as long as it can charge the power storage unit 144 or supply electric power to the circuit module 14. Where a conventional power connector functions as the charging connector 146, utility electricity is processed by a rectifilter and then used to charge the power storage unit 144 or directly supplied to the circuit module 14. Where a USB connector functions as the charging connector 146, it is inserted into a computer or another electronic device to charge the power storage unit 144 or to be directly supplied to the circuit module 14.

Referring to FIG. 6, each circuit module 14 further comprises a light-emitting element 147*a* connected to the processor 145 and adapted to produce light, so as to indicate that the sound-generating device is the master. Preferably, the light-emitting element 147*a* is an LED element. Hence, during the connection procedure, if the sound-generating device defines itself as a master, the light-emitting element 147*a* of the circuit module 14 of the master will emit light. For example, the LED element lights up, flashes, or changes color.

Figure 8:
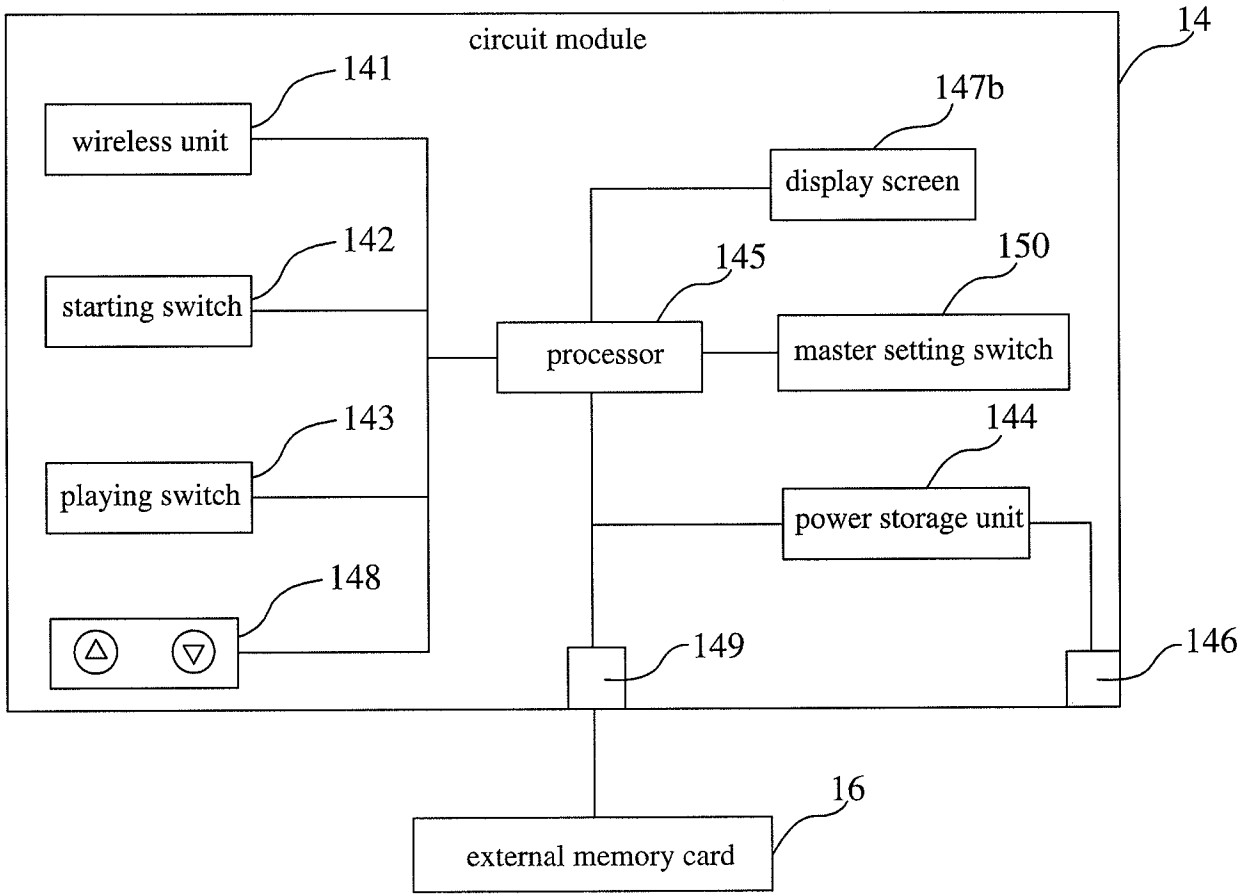
FIG. 8 is a block diagram of a circuit module of the sound-generating device in FIG. 1.

Referring to FIG. 8, each circuit module further comprises a display screen 147*b* connected to the processor 14 and adapted to display a message for indicating that the sound-generating device is a master and display the name of the play datum. Preferably, the display screen is a liquid crystal display (LCD) and displays the full name of the owner of the sound-generating device. However, the display screen can display various required information, and thus the present invention is not limited to the aforesaid name of the play datum and the aforesaid sound-generating devices. In practice, it is feasible that the light-emitting element 147*a* in FIG. 6 and the display screen 147*b* in FIG. 8 coexist.

Referring to FIG. 6 and FIG. 8, each circuit module 14 further comprises at least two buttons 148 for selecting and inputting the name of the play datum, respectively. For example, the name of the play datum is selected with upper and lower buttons, wherein, after pressing one of the two buttons for a period of time, the user enters the currently selected play datum. Alternatively, after pressing the other one of the two buttons for a period of time, the user cancels the currently selected play datum.

Referring to FIG. 6 and FIG. 8, each circuit module 14 further comprises an expansion slot 149 connected to the processor 145 and connected to an external storage unit 16. The external storage unit 16 is selectively a flash memory or a solid-state hard disk drive for storing electronic documents. The expansion slot 149 is a memory card slot, a USB slot, an IEEE 1394 slot, or any appropriate electrical slot, for connecting to the external storage unit 16.

Referring to FIG. 6 and FIG. 8, each circuit module 14 further comprises a master setting switch 150. If the master setting switch 150 is turned on, the sound-generating device will be compulsorily set to a master, and the role-related datum in the storage module of the sound-generating device is disabled. For example, the user sets the sound-generating device playing the role of the violoncello to the master device, such that the sound-generating device playing the role of the first violinist is unable to acquire leadership. After the master setting switch 150 has been turned off, the sound-generating device accesses the role-related datum in its storage module. The above-mentioned refers to a general setting and status. When unnecessary, the master setting switch 148 can be dispensed with.

Figure 9:
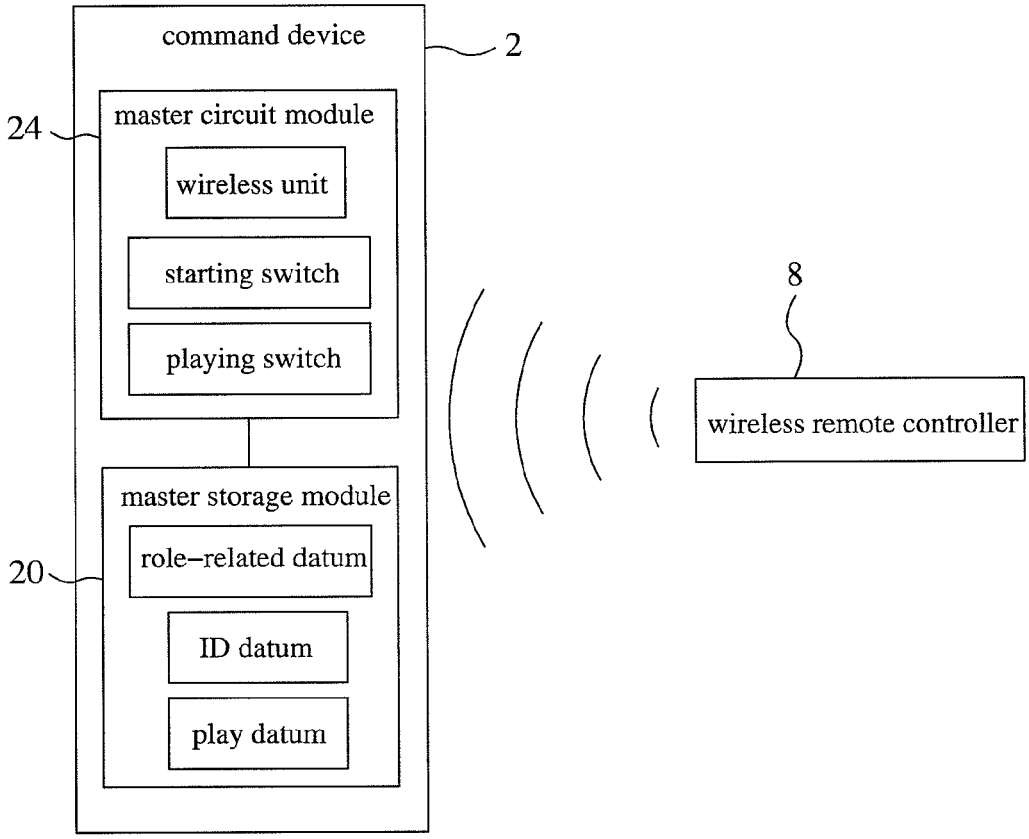
FIG. 9 is a block diagram of a command device and a wireless remote controller.

Referring to FIG. 9, the chorusing toy system further comprises a command device 2. The command device 2 comprises a master storage module 20 and a master circuit module

24. The master storage module 20 stores a master role datum, a master ID datum, and at least a play datum. Each play datum has a name and multiple syllables. The name of the play datum is identical to the name of the play datum in the storage module of the sound-generating devices. The master circuit module 24 is connected to the master storage module 20 and defines itself directly as the master according to the master role datum. Hence, the command device 2 is the aforesaid conductor having paramount precedence during a symphonic performance. The master role datum of the command device 2 is preset to 00. The command device 2 executes each step in the aforesaid connection procedure, playing procedure and participating procedure.

The chorusing toy system further comprises a wireless remote controller 8 (shown in FIG. 9) for sending a playing signal. The playing signal starts a playing switch of the master device. Once the master 2 receives the playing signal from the wireless remote controller 8, the circuit module of the master 2 can inform another sound-generating device to start executing the playing procedure. Furthermore, the wireless remote controller 8 selects, by remote control, a document to be played. However, if the controller is unnecessary, the controller can be dispensed with. A point to note is that the wireless remote controller 8 can exercise remote control over the aforesaid sound-generating devices.

What is claimed is:

1. A chorusing toy system, comprising:

multiple sound-generating devices each comprising a storage module, a sound-generating unit, and a circuit module, the storage module storing a role-related datum, an ID datum, and at least a play datum, the play datum corresponding to the role-related datum, respectively, and each having a name and multiple syllables, the circuit module being connected to the storage module and the sound-generating unit and comprising a wireless unit, a starting switch, and a playing switch, wherein, the circuit module is configured such that if the starting switches are turned on, the circuit modules will execute a connection procedure for connecting the circuit modules to each other via the wireless units and defining one of the sound-generating devices as a master according to priority given to each role-related datum, wherein the circuit module of the master create a member datum from the connected sound-generating devices and store the member datum in the storage module of the master, the member datum comprising the role-related datum and the ID datum of each sound-generating device, wherein, the circuit module is configured such that if the playing switch of the circuit module of the master is turned on, the circuit module will execute a playing procedure, the playing procedure comprising the steps of:

sending a name of the playing datum from the wireless unit of the circuit module of the master to each sound-generating device included in the member datum, so as to turn on the playing switch of each said sound-generating device;

receiving the name by the wireless unit of the circuit module of each said sound-generating device and sending a received signal to the wireless unit of the circuit module of the master; and determining, after the circuit module of the master has received the received signals, whether all the sound-generating devices have received the name according to the received signals and the member datum, wherein, when the determination is affirmative, the wireless unit of the circuit module of the master sends a start signal such that, after the circuit module of the sound-generating device has received the start signal, the sound-generating unit of the sound-generating devices starts playing each syllable of the play datum of the name, wherein, at the point in time when the playing of each syllable ends, the wireless unit of the circuit module of the sound-generating device reports to the circuit module of the master to enable the circuit module of the master to monitor a play status, wherein, when the determination is negative, the circuit module of the master waits a predetermined time period before sending a start signal such that, after the circuit module of the sound-generating device has received the start signal, the sound-generating unit of the sound-generating devices starts playing each syllable of the play datum of the name, wherein, at the point in time when the playing of each syllable ends, the wireless unit of the circuit module of the sound-generating device reports to the circuit module of the master to enable the circuit module of the master to monitor a play status.

2. The chorusing toy system of claim 1, wherein the connection procedure comprises the steps of:

sending the role-related datum and the ID datum from the wireless unit of each said circuit module;

receiving the role-related datum and ID datum of another sound-generating device by the wireless unit of each said circuit module; and comparing and determining by each said circuit module whether the role-related datum thereof has priority over the role-related datum of another sound-generating device, wherein an affirmative determination leads to the step of defining by the circuit module itself as the master and sending from the wireless unit thereof the role-related datum and ID datum of the master to the circuit module of another sound-generating device, wherein, after the circuit module of another sound-generating device has received the role-related datum and the ID datum of the master, the circuit module of said another sound-generating device sends its own role-related datum and ID datum to the master, and then the circuit module of the master receives the role-related datum and ID datum so as to create the member datum and store the member datum in its storage module, wherein a negative determination leads to the step of waiting to receive the role-related datum and ID datum of the master.

3. The chorusing toy system of claim 1, wherein, if a starting switch of a new sound-generating device is turned on, the new sound-generating device is a sound-generating device not included in the member datum, wherein the circuit modules of the new sound-generating device and the master execute a participating procedure, the participating procedure comprising the steps of:

sending from the wireless unit of the circuit module of the new sound-generating device its own role-related datum and ID datum;

receiving the role-related datum and the ID datum of the new sound-generating device by the circuit module of the master; and comparing and determining, by the circuit module of the master, whether its role-related datum has priority over the role-related datum of the new sound-generating device, wherein an affirmative determination leads to specifying the new sound-generating device in the member datum by the circuit module of the master, wherein a negative determination leads to undoing a master's setting by the circuit module of the master, sending the member datum from the wireless unit to the new sound-generating device such that the new sound-generating device becomes a new master, and sending the member datum from the circuit module of the new master to the storage module of the new master for storage.

4. The chorusing toy system of claim 3, wherein, if the role-related datum of the master and the role-related datum of the new sound-generating device are equal in priority, the circuit module of the master will include the new sound-generating device in the member datum.

5. The chorusing toy system of claim 1, wherein each said circuit module further comprises a power storage unit and a processor, the power storage unit storing electric power and supplying electric power to the processor, the processor being connected to the wireless unit, the starting switch, the playing switch, and the power storage unit, wherein the circuit module of the master monitors a play status by following the steps of:

processing and converting, by the processor of the circuit module of each said sound-generating device, residual electric power of the power storage unit and a point in time when the playing of each said syllable ends into a monitoring signal;

sending the monitoring signal from the wireless unit of each said circuit module to the master; and receiving and processing, by the circuit module of the master, the monitoring signals to determine whether the sound-generating devices play same said syllables at the same time, wherein an affirmative determination leads to monitoring the sound-generating devices continuously, wherein a negative determination leads to generating an acceleration signal by the processor of the circuit module of the master according to the monitoring signals and sending the acceleration signal to the circuit modules of the sound-generating devices playing same said syllables at different time such that the sound-generating devices become equal in a playing speed thereof.

6. The chorusing toy system of claim 5, wherein each said circuit module further comprises a charging connector connected to an external power source and configured to charge the power storage unit or supply electric power to the circuit module.

7. The chorusing toy system of claim 5, wherein each said circuit module further comprises a light-emitting element connected to the processor and configured to produce light for indicating that the sound-generating device is the master.

8. The chorusing toy system of claim 5, wherein each said circuit module further comprises a display screen connected to the processor and configured to display a message for indicating that the sound-generating device is a master and display a name of the play datum.

9. The chorusing toy system of claim 1, wherein each said circuit module further comprises at least two buttons for selecting and entering the name of the play datum, respectively.

10. The chorusing toy system of claim 1, wherein each said circuit module further comprises an expansion slot connected to the processor and connected to an external memory card.

11. The chorusing toy system of claim 1, wherein each said circuit module further comprises a master setting switch which, when turned on, sets the sound-generating device to a master compulsorily and disables the role-related datum in its storage module, wherein, when the master setting switch is turned off, the sound-generating device accesses the role-related datum in its storage module.

12. The chorusing toy system of claim 1, further comprising a command device, the command device comprising a master storage module and a master circuit module, the master storage module storing a master role datum, a master ID datum, and at least a play datum, each said play datum having a name and multiple syllables, wherein the name of the play datum is identical to the name of the play datum in a storage module of the sound-generating devices, the circuit module being connected to the storage module and configured to define itself directly as the master according to the master role datum.

13. The chorusing toy system of claim 1, further comprising a wireless remote controller for sending a playing signal configured to turn on a playing switch of the master.

14. The chorusing toy system of claim 1, wherein the predetermined time period lasts five seconds or less.

* * * * *